US007290983B2

(12) United States Patent
Tiemann

(10) Patent No.: US 7,290,983 B2
(45) Date of Patent: Nov. 6, 2007

(54) TURBINE, FIXING DEVICE FOR BLADES AND WORKING METHOD FOR DISMANTLING THE BLADES OF A TURBINE

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/539,930

(22) PCT Filed: Dec. 4, 2003

(86) PCT No.: PCT/EP03/13711

§ 371 (c)(1),
(2), (4) Date: May 2, 2006

(87) PCT Pub. No.: WO2004/057158

PCT Pub. Date: Jul. 8, 2004

(65) Prior Publication Data

US 2006/0251518 A1 Nov. 9, 2006

(30) Foreign Application Priority Data

Dec. 19, 2002 (EP) ..... 02028511

(51) Int. Cl.
*F01D 9/02* (2006.01)

(52) U.S. Cl. ..... 415/190; 415/209.3

(58) Field of Classification Search ..... 415/189, 415/190, 209.2, 209.3, 209.4, 210.1; 29/426.1, 29/426.3, 426.5, 889.1; 60/796, 798, 800
See application file for complete search history.

(56) References Cited

U.S. PATENT DOCUMENTS

| | | | | | |
|---|---|---|---|---|---|
| 2,445,661 | A | * | 7/1948 | Constant et al. | 415/209.3 |
| 2,488,875 | A | * | 11/1949 | Morley | 415/209.3 |
| 2,851,246 | A | * | 9/1958 | Nichols | 415/190 |
| 3,067,983 | A | * | 12/1962 | Koziura | 415/209.2 |
| 4,009,969 | A | | 3/1977 | Kadera et al. | |
| 4,511,306 | A | * | 4/1985 | Hultgren | 415/190 |
| 4,684,320 | A | | 8/1987 | Kunz | |
| 5,073,084 | A | * | 12/1991 | Hirst | 415/209.3 |
| 5,848,874 | A | | 12/1998 | Heumann et al. | |

FOREIGN PATENT DOCUMENTS

| | | | | |
|---|---|---|---|---|
| DE | 606 029 | | 11/1934 | |
| DE | 195 46 722 | A1 | 6/1997 | |
| GB | 368601 | A * | 3/1932 | 415/189 |
| JP | 52-68610 | A * | 6/1977 | 415/189 |

* cited by examiner

*Primary Examiner*—Richard A. Edgar

(57) ABSTRACT

A turbine and a method for dismantling a blade of a turbine. A turbine includes a rotor that extends in an axial direction and an accessible combustion chamber, which communicates with an annular hot-gas conduit, in which a plurality of blades that form a blade row is arranged. Each blade has a blade root that is fixed to the internal housing and a blade head that lies opposite the root and faces the rotor, the head being fixed to a fixing ring of the turbine that encircles the rotor. To reduce the down time of a turbine during repair, inspection and/or maintenance work, the blade root and/or the blade head can be fixed by means of a manually detachable clamping device. The clamping device is released from the blade and locked in a parking position beyond a displacement path used for removing the blade through the combustion chamber.

11 Claims, 2 Drawing Sheets

TURBINE, FIXING DEVICE FOR BLADES AND WORKING METHOD FOR DISMANTLING THE BLADES OF A TURBINE

CROSS REFERENCE TO RELATED APPLICATION

This application is the U.S. National Stage of International Application No. PCT/EP2003/013711, filed Dec. 4, 2003 and claims the benefit thereof. The International Application claims the benefits of European Patent application No. 02028511.0 EP filed Dec. 19, 2002, both of the applications are incorporated by reference herein in their entirety.

FIELD OF THE INVENTION

The present invention relates to a turbine according to the preamble of the claims, a fixing device for guide blades of a turbine according to the preamble of the claims and a method for removing the guide blades of a turbine according to the preamble of the claims.

BACKGROUND OF THE INVENTION

DE 606 029 discloses the production of a guide-blade ring for steam or gas turbines in which bands or strips are placed around two rollers, so that they assume an annular form. The bands or strips are provided with cutouts, into which the blades are inserted. After all the blades have been inserted, the guide-blade ring is welded. In the process, the blades are first of all fixed to the strips (which form the platforms) by means of spot welds and the welding is then continued as deposition welding on the outside of the bands or strip until a sufficiently thick layer of the welding metal is formed, which can then be partly turned down. To this end, the welded guide-blade ring is chucked in place in a lathe and machined until a coaxially encircling extension of dovetailed cross section remains. The encircling extension, i.e. the one-piece guide-blade ring, is then fixed in a circular holder which can be clamped by screws or rivets.

DE 195 46 722 A1 discloses a guide-blade carrier for a gas turbine. On its inside facing the hot-gas duct, the guide-blade carrier has a plurality of slots which are arranged one behind the other in its axial longitudinal extent and which run in an annular manner in the circumferential direction and are at the same time provided with a respective undercut. The slots serve to accommodate guide-blade roots of a guide blade. To this end, the root of a guide blade is pushed in the circumferential direction into the slot running in an annular manner.

For repair, inspection and/or maintenance work on the guide blades, they must be removed from the gas turbine. To this end, the gas turbine is opened, so that the guide-blade carrier is accessible and the guide blades can be pushed out of the slot. The opening of the gas turbine is time-consuming and requires a corresponding long shutdown of the gas turbine.

SUMMARY OF THE INVENTION

The object of the present invention is to reduce the downtimes of the turbine during repair, inspection and/or maintenance work.

The object is achieved by the features and measures of the claims. Further advantageous configurations of the invention are given in the subclaims.

The solution according to the invention provides for the guide-blade root and/or the guide-blade tip to be capable of being secured by means of a manually releasable clamping device. The downtimes of the gas turbine can be beneficially reduced by virtue of the fact that the guide blade to be exchanged can be removed through the accessible combustion chamber. To this end, at least one clamping device securing the guide blade can be reached from the combustion chamber. The one clamping device securing the guide-blade root is provided on the inner casing and/or the other clamping device secures the guide-blade tip and is arranged on the fixing ring. After the release of the clamping device(s), therefore, each guide blade can thus be removed from the combustion chamber without the inner casing of the turbine having to be opened.

In an advantageous development, provision is made for the clamping device to be capable of being secured to the inner casing or to the fixing housing, respectively, and for it to fasten the guide-blade root or the guide-blade tip, respectively, in an operating position by means of a tie rod running in the axial direction. During the fixing of the guide blade, the inner casing or the fixing ring, respectively, serves as an abutment for the clamping device. The tie rod fastens the clamping device first on the inner casing or on the fixing ring, respectively, and then on the guide blade.

In a further configuration, to remove the guide blade through the combustion chamber, at least that part of the clamping device which faces the combustion chamber can be removed from the clearance profile of the guide blade after the release of the tie rod. The clearance profile of the guide blade is described by the contour of the guide blade as viewed from the combustion chamber in the axial direction. The guide blade is exposed after removal of the clamping device from the clearance profile.

If, in a further configuration, the clamping device is fixed in a parking position exposing the guide-blade root or guide-blade tip, respectively, this cannot impair the removal of the guide blades. Consequently, the clamping device cannot get caught inadvertently on the guide blade during its removal. Furthermore, the clamping device is effectively protected against falling out unintentionally. Components which have fallen out unintentionally may lead to mechanical destruction during operation of the gas turbine.

In an advantageous proposal, the clamping device comprises two radially extending retaining stops which can be fastened by means of the tie rod. The two retaining stops of a clamping device in each case enclose elements of the inner casing as abutment and at the same time the guide-blade root or the guide-blade tip, respectively. To secure the guide blade to the inner casing, the retaining stops can be fastened by means of the tie rod.

The guide blade is advantageously located in the first guide-blade row as viewed in the direction of flow of a working medium. This makes it easier to reach the guide blade from the combustion chamber.

The clamping device can expediently be removed from the inner casing after removal of the guide blade.

It is considered to be especially advantageous if a guide ring arranged downstream in the direction of flow of a working medium is manually accessible after removal of the clamping device fixed to the inner casing. Therefore, in a similar manner to the guide blade, the guide ring, which is subject to wear, can be reached especially easily and quickly for maintenance and/or repair work without having to open the inner casing of the turbine.

A fixing device for guide blades of a turbine is described by the features of the claims.

The solution according to the invention provides for the fixing device to comprise a manually releasable clamping device accessible from the combustion chamber. The downtimes of a gas turbine can be beneficially reduced by virtue of the fact that the guide blade to be exchanged can be removed through the accessible combustion chamber. To this end, at least one clamping device, as fixing device, securing the guide blade can be reached from the combustion chamber. The one clamping device securing the guide-blade root is provided on the inner casing and/or the other clamping device secures the guide-blade tip and is arranged on the fixing ring. After the release of the clamping device(s), therefore, each guide blade can be removed from the combustion chamber without the inner casing of the turbine having to be opened.

In an advantageous configuration of the fixing device, the clamping device comprises two radially extending retaining stops which can be fastened by means of the tie rod. The two retaining stops of a clamping device in each case enclose elements of the inner casing as abutment and at the same time the guide-blade root or the guide-blade tip, respectively. To secure the guide blade to the inner casing, the retaining stops can be fastened by means of the tie rod.

A working method for removing the guide blades of a turbine is described by the features of the claims.

The invention provides for a guide blade of the first guide-blade row as viewed in the direction of flow of the working medium to be removed manually through the combustion chamber by the sequence of the following steps:

The clamping device arranged on the inner casing is released, displaced into a parking position exposing the guide-blade root and fixed there again. If appropriate, the other clamping device arranged at the inner fixing ring is released, so that the guide-blade tip is exposed. After that the guide blade is displaced axially against the direction of flow of the working medium, is moved radially inward if need be and is tilted about the guide-blade tip, so that the guide blade is then free after being moved radially outward. This procedure avoids opening the entire turbine and considerably reduces the downtimes of the turbine which are caused by maintenance and repair times. The parking in a parking position prevents the clamping device from accidentally falling out and thus permits the trouble-free removal of the guide blade.

BRIEF DESCRIPTION OF THE DRAWINGS

The invention is explained in more detail with reference to a drawing, in which.

DETAILED DESCRIPTION OF THE INVENTION

Figure 1:
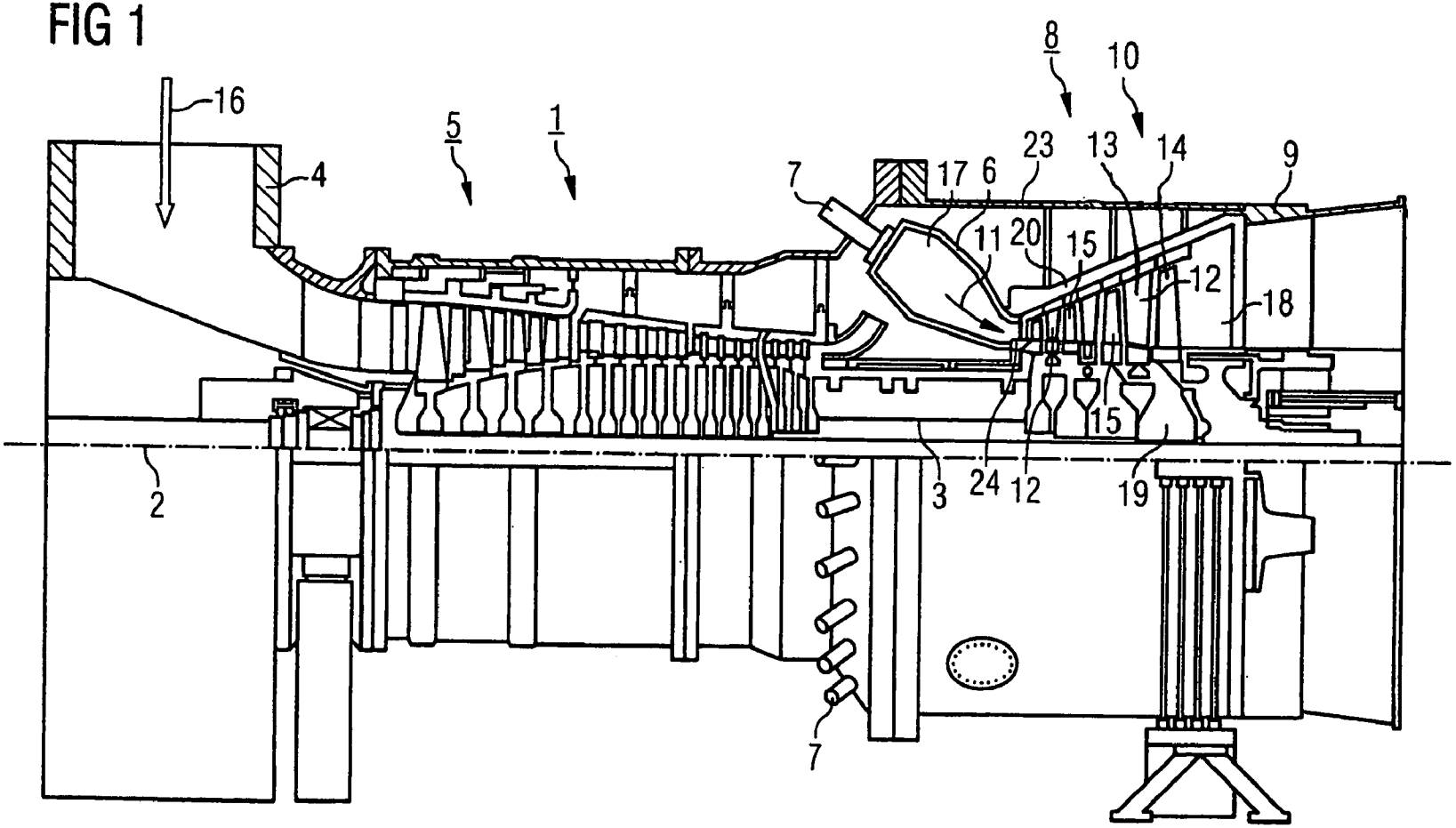
FIG. 1 shows a gas turbine in a longitudinal partial section.

FIG. 1 shows a gas turbine 1 in a longitudinal partial section. In the interior, the gas turbine 1 has a rotor 3 which is rotatably mounted about a rotation axis 2 and is also designated as turbine wheel. Following one another along the rotor 3 are an intake casing 4, a compressor 5, a toroidal annular combustion chamber 6 having a plurality of coaxially arranged burners 7, a turbine 8 and the exhaust-gas casing 9. In this case, the annular combustion chamber 6 forms a combustion space 17 which communicates with an annular hot-gas duct 18. The turbine 8 is formed there by four turbine stages 10 arranged one behind the other. Each turbine stage 10 is formed from two blade rings. As viewed in the direction of flow of a working medium 11, a row 14 formed from moving blades 15 follows a guide-blade row 13 in the hot-gas duct 18. In this case, the guide blades 12 are fixed to the stator 23, whereas the moving blades 15 of a row 14 are attached to the rotor 3 by means of a turbine disk 19. A generator or a driven machine (not shown) is coupled to the rotor 3.

During the operation of the gas turbine 1, air 16 is drawn in through the intake casing 4 and compressed by the compressor 5. The compressed air provided at the turbine-side end of the compressor 5 is passed to the burners 7 and is mixed there with a fuel. The mixture is then burned in the combustion space 17 while forming the working medium 11. From there, the working medium 11 flows along the hot-gas duct 18 past the guide blades 12 and the moving blades 15. The working medium 11 expands at the moving blades 15 in an impulse-transmitting manner, so that the moving blades 15 drive the rotor 3 and the latter drives the driven machine coupled to it.

The components exposed to the hot working medium 11 are subjected to thermal loads during the operation of the gas turbine 1. The guide blades 12 and moving blades 15 of the first turbine stage 10 as viewed in the direction of flow of the working medium 11, in addition to the heat shield blocks lining the annular combustion chamber 6, are subjected to the greatest thermal loading. In order to withstand the temperatures prevailing there, said guide blades 12 and moving blades 15 are cooled by means of a coolant.

Figure 2:
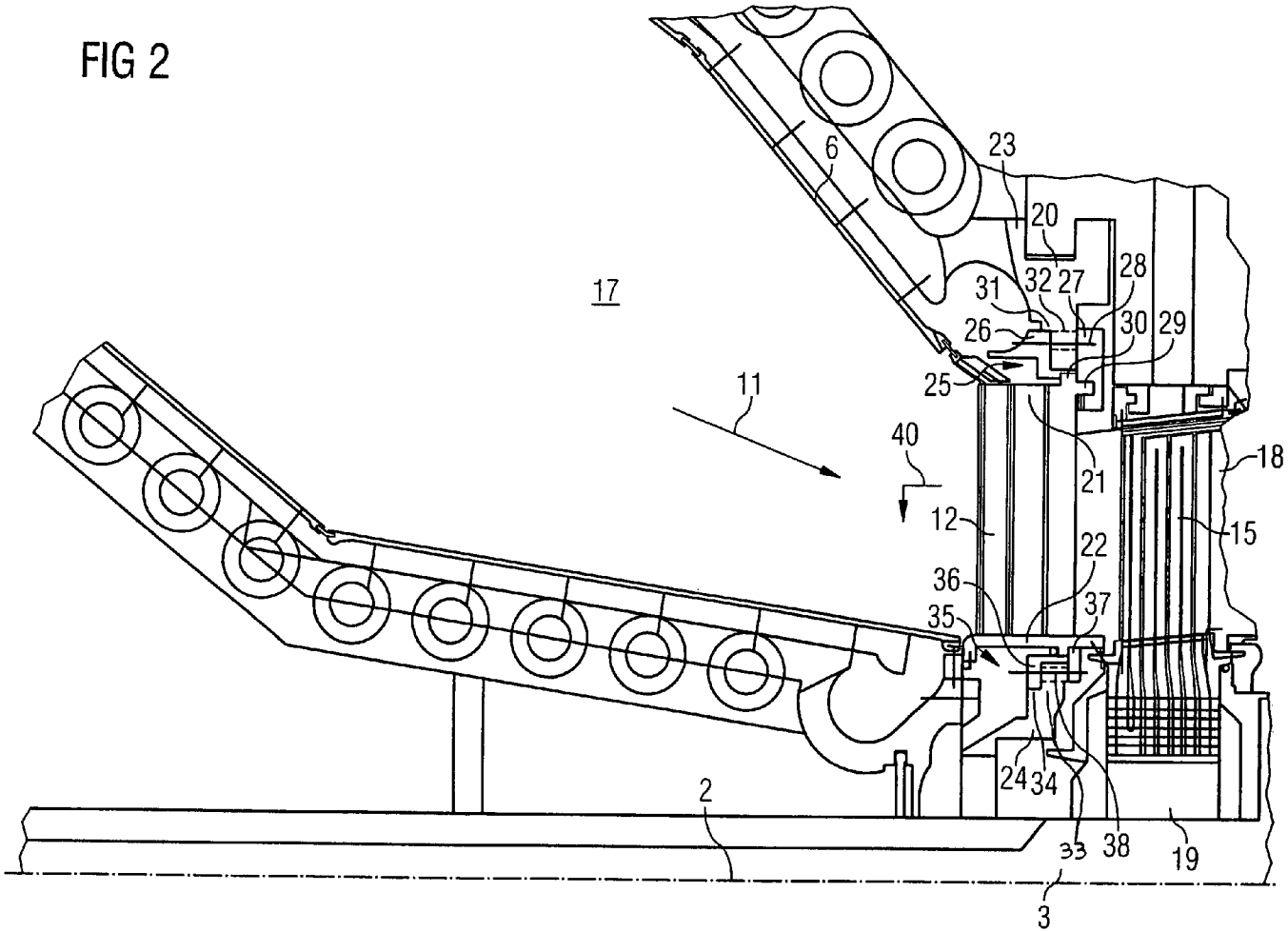
FIG. 2 shows the combustion chamber, the hot-gas duct, the guide blade and the moving blade of the first turbine stage in a partial cross section according to FIG. 1.

FIG. 2 shows a section through a partly shown annular combustion chamber 6 and through the first turbine stage 10, which is formed from the guide blade 12 and the downstream moving blade 15. In this case, the blades 12, 15 are arranged radially around the rotor 3 of the gas turbine. The moving blade 15 sits on a turbine disk 19, which is arranged on the rotor 3, whereas the guide blade 12 is fixed to the stator. The guide blade 12 has a guide-blade root 21 facing the inner casing 20 of the turbine 8 and a guide-blade tip 22 opposite the guide-blade root 21. The guide-blade tip 22 faces the rotor 3 and is secured to a fixing ring 24 of the stator 23.

A clamping device 25 arranged at the guide-blade root 21 and at the inner casing 20 is located in an operating position. The clamping device 25 comprises two retaining stops 26, 27 and a helical tie rod 28, which is only intimated here. The retaining stop 27 encloses a projection 29 which is integrally formed on the guide-blade root 21 and extends parallel to the axial direction of the rotor 3. A further projection 30 extending in the radial direction of the rotor 3 is likewise integrally formed on the guide-blade root 21. This projection 30 projects in between the two retaining stops 26, 27 in such a way that the latter firmly clamp the projection 30 in place when the tie rod 28 is fastened. The inner casing 20 serves as an abutment for the clamping device 25, which secures the guide-blade root 21 and thus also the guide blade 12 itself.

The tie rod 28 runs through the inner casing 20, in which case it extends through an axial bore 32 which is in the shape of an elongated hole as viewed in the radial direction. Arranged next to it radially on the outside on the inner casing 20 is a projection 31.

In a similar manner to the arrangement at the guide-blade root 21, a further clamping device 25 is arranged in its operating position at the guide-blade tip 22 and at the fixing ring 24. This clamping device 25 has two retaining stops 36, 37 which clamp a radially protruding third projection 33 in place on the fixing ring 24 by means of a tie rod 38, this projection 33 being integrally formed on the guide-blade tip 22.

To remove the guide blade 12, the following steps are carried out after the clamping devices 25, 35 in the combustion chamber, which can be reached by a fitter, have been exposed:

The clamping device 25 arranged at the guide-blade root 21 is released by the two retaining stops 26, 27 being slackened by the release of the tie rod 28 to such an extent that the retaining stop 27 releases the projection 29. At the same time, the retaining stop 26 is displaced in the direction of the annular combustion chamber 6 to such an extent that the projection 31 can be enclosed by said retaining stop 26. The clamping device 25, i.e. the first retaining stop 26, the second retaining stop 27 and the tie rod 28, is then moved radially outward as a unit. To this end, the axial bore 32 is designed like an elongated hole in cross section. The tie rod 28 is fastened again in the radially outer position, so that the clamping device 25 is located in its parking position in a secured manner. The guide-blade root 21 is completely released from it. As viewed from the annular combustion chamber 6, the contour of the first retaining stop 26 is located outside the contour of the guide-blade root 21, i.e. the clamping device 25 is located outside the clearance profile of the guide blade 12.

The guide-blade tip 22 is exposed in a similar manner by the tie rod 38 of the clamping device 35 arranged on the fixing ring 24 being released for this purpose, so that the retaining stops 36, 37 release a third projection 33 integrally formed on the guide-blade tip 22. The movable clamping device 35 is moved radially inward to such an extent that it encloses a projection 34 of the fixing ring 24. The clamping device 35 is then fastened again, so that it is located in its parking position. In a similar manner to the clamping device 25 at the guide-blade root 21, the clamping device 35 arranged at the guide-blade tip 22 is located outside the clearance profile of the guide blade 12.

The guide blade 12 thus exposed can now be removed from the guide-blade row 13 by being displaced against the direction of flow of the working medium 11 and by then being displaced slightly radially inward. This displacement path is identified by the arrow 40. The guide blade 12 is then tilted about the guide-blade tip 22 in the direction of the combustion chamber 6. After that, the guide blade 12 is moved into the combustion space 17 of the annular combustion chamber 6 and removed from the gas turbine 1.

The invention claimed is:

1. A turbine, comprising:

a rotor extending in the axial direction;

an accessible combustion chamber which communicates with an annular hot-gas duct; and a multiplicity of guide blades arranged in such a way as to form a guide-blade row, each guide blade having a guide-blade root fixed to an inner casing and a guide-blade tip which is opposite the guide-blade root, faces the rotor and is fixed to a fixing ring, enclosing the rotor, of the turbine, wherein the guide-blade root and the guide-blade tip of each guide blade are respectively secured by a manually releasable clamping device accessible from the combustion chamber without the inner casing having to be opened.

2. The turbine as claimed in claim 1, wherein the clamping device is secured to the inner casing or to the fixing ring, respectively, and fastens the guide-blade root or the guide-blade tip, respectively, in an operating position by means of a tie rod running in the axial direction.

3. The turbine as claimed in claim 1, wherein to remove the guide blade through the combustion chamber, part of the respective clamping device that faces the combustion chamber is moved radially away from a clearance profile of the guide blade by moving a tie rod of the clamping device in a radial direction within an elongated hole formed in the inner casing.

4. The turbine as claimed in claim 1, wherein to remove the guide blade each respective clamping device is fixed in a parking position exposing the respective guide-blade root or guide-blade tip.

5. The turbine as claimed in claim 1, wherein each respective clamping device comprises two radially extending retaining stops that can be fastened by a tie rod.

6. The turbine as claimed in claim 1, wherein the guide blade is arranged in a first guide-blade row as viewed in the direction of flow of a working medium.

7. The turbine as claimed in claim 1, wherein each respective clamping device can be removed from the inner casing after removal of the guide blade.

8. The turbine as claimed in claim 1, wherein a guide ring arranged downstream in the direction of flow of a working medium is manually accessible after removal of the clamping device fixed to the inner casing.

9. A method of removing a blade from a turbine having a rotor extending in the axial direction and an accessible combustion chamber which communicates with an annular hot-gas duct wherein a multiplicity of guide blades are arranged in such a way as to form a guide-blade row, each guide blade having a guide-blade root fixed to an inner casing and a guide-blade tip which is opposite the guide-blade root, faces the rotor and is fixed to a fixing ring, enclosing the rotor, wherein a first guide blade of a first guide-blade row as viewed in a direction of flow of a working medium is removed manually through the combustion chamber, comprising:

releasing a root clamping device affixing the first guide blade root to the inner casing and displacing the root clamping device into a parking position exposing the root of the first guide blade and securing the root clamping device to the inner casing in the parking position displaced from a clearance profile of the first guide blade, releasing a tip clamping device affixing the first guide blade tip to the fixing ring and displacing the tip clamping device into a parking position so that the guide-blade tip is exposed, and securing the tip clamping device to the inner fixing ring in the parking position displaced from a clearance profile of the first guide blade; and displacing the first guide blade axially against the direction of flow of the working medium past the root and tip clamping devices into the combustion chamber and out of the turbine without opening the inner casing.

10. A turbine comprising:

an inner casing supported within a stator and defining an annular hot gas duct;

a combustion chamber in fluid communication with the hot gas duct;

a rotor comprising a row of moving blades rotatably supported within the inner casing;

a guide blade disposed upstream of the row of moving blades relative to a working medium flowing from the combustion chamber through the hot gas duct during operation of the turbine;

a clamping device selectively affixable to the inner casing in a radially inward operating position for securing the guide blade to the inner casing during operation of the turbine and selectively affixable to the inner casing in a radially outward parking position remote from a clearance profile of the guide blade during removal of the guide blade from the turbine through the combustion chamber without opening of the inner casing during maintenance of the turbine.

11. The turbine of claim 10, further comprising:

an elongated hole formed in the inner casing; and a tie rod of the clamping device extending through a radially inward portion of the elongated hole to secure the clamping device in the operating position and extending through a radially outward portion of the elongated hole to secure the clamping device in the parking position.

* * * * *